United States Patent [19]

Nelson

[11] Patent Number: 4,491,319

[45] Date of Patent: Jan. 1, 1985

[54] SKILL GAME CARD DEVICE

[76] Inventor: Edward D. Nelson, 1801 Pheasant Trail, Inverness, Ill. 60067

[21] Appl. No.: 541,977

[22] Filed: Oct. 14, 1983

[51] Int. Cl.[3] ..... B42D 15/00; A63F 9/18

[52] U.S. Cl. ..... 273/1 R; 273/139

[58] Field of Search ..... 273/1, 139

[56] References Cited

U.S. PATENT DOCUMENTS

| | | | |
|---|---|---|---|
| 3,773,328 | 11/1973 | Seidman | 273/139 |

FOREIGN PATENT DOCUMENTS

| | | | |
|---|---|---|---|
| 498732 | 2/1951 | Belgium | 273/1 R |
| 411460 | 8/1945 | Italy | 273/139 |
| 8100699 | 9/1982 | Netherlands | 273/139 |
| 1463239 | 2/1977 | United Kingdom | 273/139 |

OTHER PUBLICATIONS

Kentuky Derby Sweepstakes, ©1976, Promotional Marketing Corp.

Massachusetts State Lottery, "Strike It Rich", 1-1979.

*Primary Examiner*—Paul E. Shapiro

*Attorney, Agent, or Firm*—Anthony S. Zummer

[57] ABSTRACT

A skill game card device providing an apparatus for a player to engage in a game of skill. The card game device includes a substantially flat supporting sheet. A first indicia is contained on the flat supporting sheet. The first indicia depicts a plurality of figures arranged in a selected relationship as viewed in a given plane. A first layer of removable opaque coating covers the first indicia to hide from view of a player the first indicia. The flat supporting sheet has a second indicia contained thereon. The second indicia depicts the relative position of the figures depicted in the first indicia as viewed in a plane other than the given plane of the first indicia. A second layer of removable opaque coating covers the second indicia to hide from view of a player the second indicia. Means cooperate with the second layer of removable opaque coating to distinguish areas of that second layer of removable opaque coating. Separate figures of the second indicia are positioned below selected areas of the second layer. A player has an opportunity to select areas of the second layer of removable opaque coating and remove the second layer in selected areas to expose selected portions of the second indicia to determine whether the player made a proper selection of an area to expose a figure.

17 Claims, 3 Drawing Figures

FIG. 1
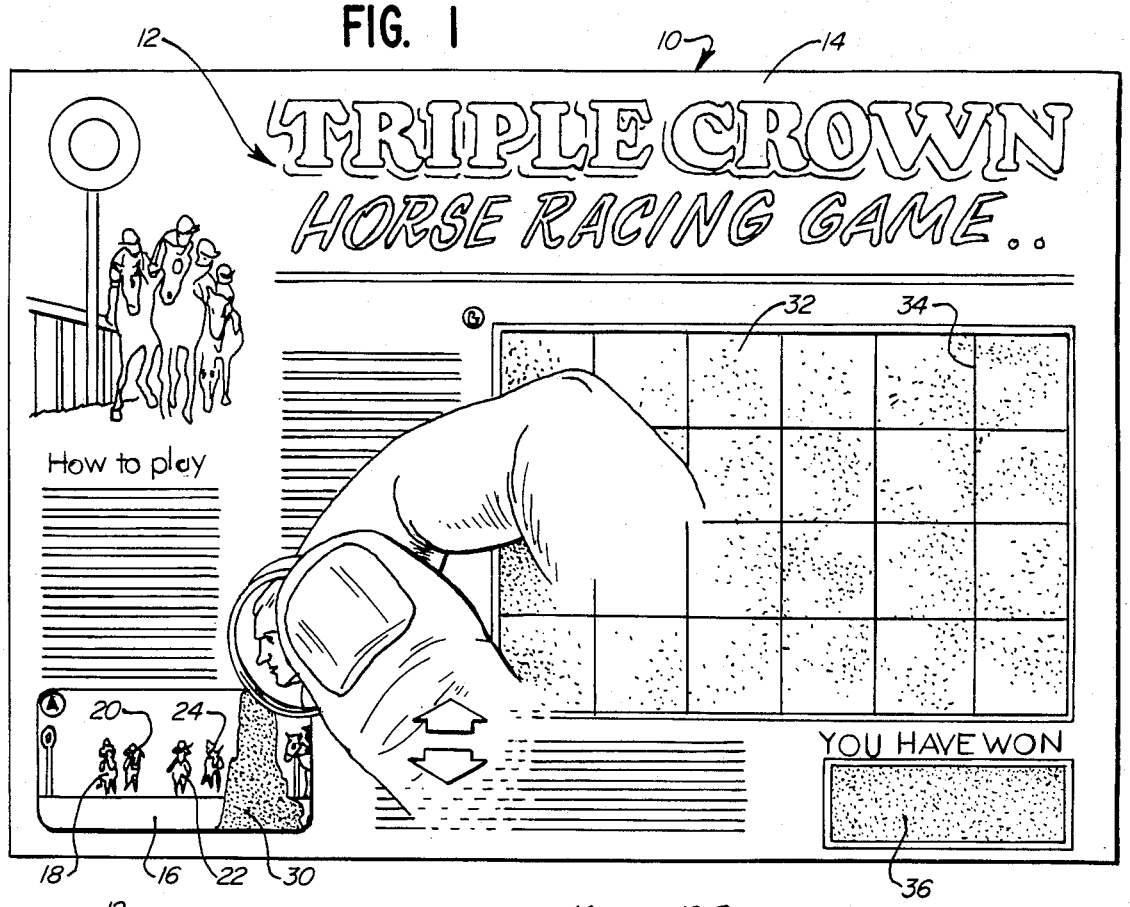
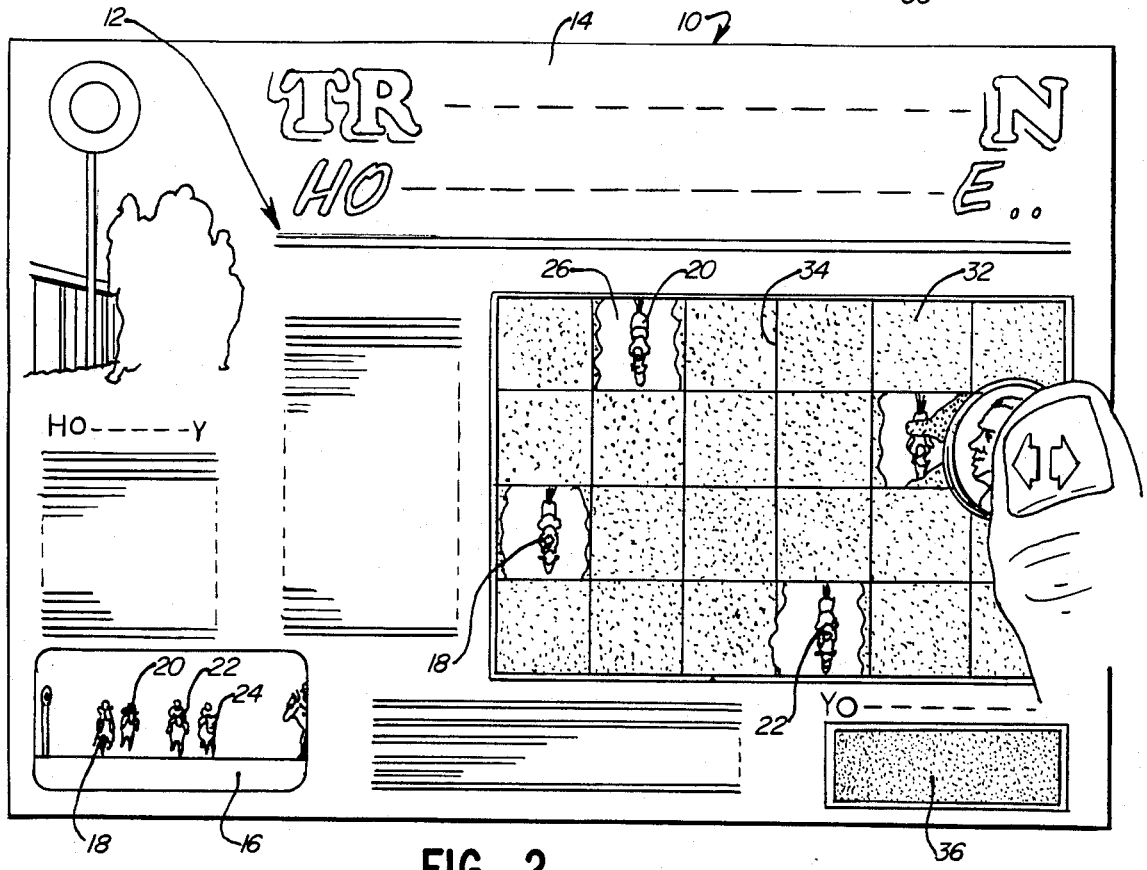
FIG. 2

SKILL GAME CARD DEVICE

BACKGROUND OF THE INVENTION

Card game devices are often used as a means for promotion of a given business. The typical card game device is designed to reward a player based upon chance. A player removes an opaque coating over a selected area to reveal whether the player is or is not eligible to receive a prize, usually from the business engaging in a promotion. In some instances, it is necessary for the player to select a plurality of proper areas for removal of an opaque coating in order to be eligible to win a prize. Very little, or no skill is required to be eligible to win a prize.

In certain game cards, such as that taught in British Pat. No. 1,463,239, entitled "Game Card Bearing A Partially Blanked-Out Photographic Print", wherein the complete specification was published Feb. 2, 1977, a certain amount of skill by the player is required to win. Said British patent discloses a card game wherein a picture is shown, and it is necessary for the player to determine where other portions of the pictures are located. Those other portions are covered with a layer of opaque removable coating material to hide those other portions from the view of the player. The player selects areas in which he believes those other portions are located and removes the layer of material in those areas. If his selection is correct, he is eligible to win a prize. One of the problems with a game card device of this type is that in certain instances, the game card device is used as part of a promotion. Employees of the establishment engaging in the promotion recognize that there is a certain repetition of exposed portions of the game card device. The employees then recognize the correct solution to a given portion or arrangement. Employees may selectively distribute game cards to friends or relatives and also disclose the correct solution to make the friends or relatives eligible to win a prize. This defeats the entire purpose of the game card device, and also increases the cost of the promotion to the business establishment.

It is recognized that various portions of a game may be coated with an opaque coating, as taught in U.S. Pat. No. 3,981,174, issued Nov. 11, 1975, to Miller et al., and entitled "Game Device".

SUMMARY OF THE INVENTION

The present invention relates to an improved skill game card device which provides an apparatus for a player to play a game of skill. The game card device includes a substantially flat supporting sheet. A first indicia is formed on one portion of the flat supporting sheet. The first indicia depicts a plurality of figures arranged in a given relationship as viewed in a given plane. A first layer of removable opaque coating material covers the first indicia to hide from view of a player the first indicia. A second indicia spaced from the first indicia is formed on the flat supporting sheet. Said second indicia depicts the relative position of the figures depicted in the first indicia but as viewed in a plane other than the plane of the first indicia. A second layer of removable opaque coating material covers the second indicia to hide from view of a player the second indicia. Means cooperate with the second layer of removable opaque coating material to distinguish areas of said second layer of removable opaque coating material. Separate indicia of separate figures of the second indicia are positioned below selected areas. A player has an opportunity to select areas of the second layer of removable opaque coating material to remove the layer in said area and thereby expose selected portions of the second indicia.

BRIEF DESCRIPTION OF THE DRAWINGS

FIG. 1 is a plan view of a game card device embodying the herein disclosed invention showing a thumb and forefinger of a player holding a coin in an attitude for removal of a portion of a layer of opaque coating material from a first indicia, and showing areas defining means in association with a second layer of removable coating material over a second indicia;

FIG. 2 is a plan view similar to FIG. 1 but showing the first layer of removable opaque coating material removed from the first indicia to expose the entire first indicia, and with selected areas of the second layer of removable opaque coating material removed to expose figures of the second indicia.

DESCRIPTION OF THE PREFERRED EMBODIMENT

Figure 3:
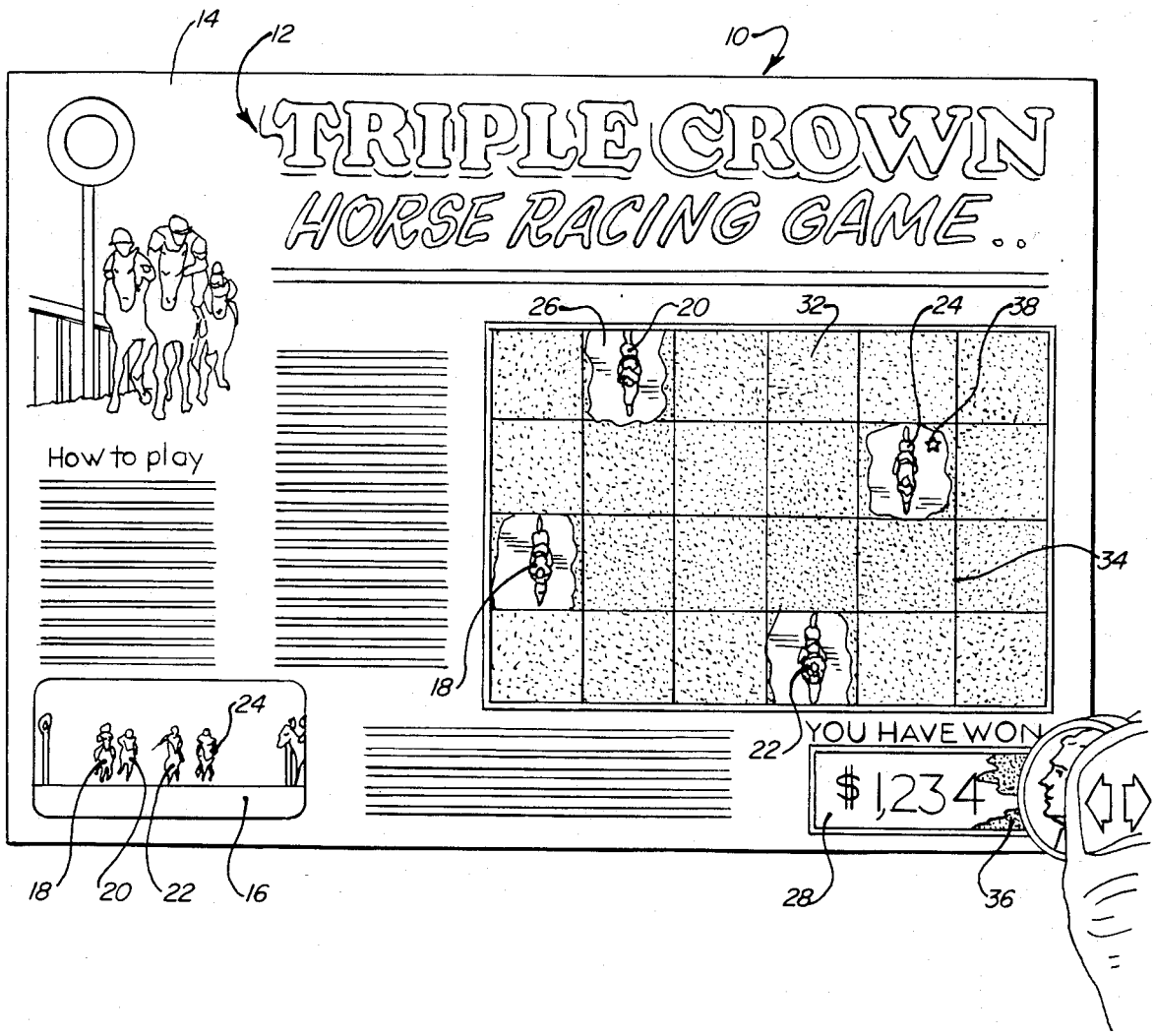
FIG. 3 is a plan view similar to FIG. 2 but showing the first layer of removable opaque coating material removed from the first indicia, selected areas of the second layer having the removable opaque coating material removed from those areas to expose portions of the second indicia, and a third layer of removable opaque coating material being removed to expose a third indicia indicating a prize.

Referring now to the drawings, a game card device generally indicated by numeral 10 is shown therein and generally is a specific embodiment of the herein disclosed invention. The game card device includes general promotional and instructional informational indicia generally indicated by numeral 12.

Looking now to the figures, it may be seen that game card 10 generally includes a flat sheet 14 which is made of cardboard or other suitable material. A first game indicia 16 is contained on one corner of sheet 12. In this instance, the first game indicia is a front view of four FIGS. 18, 20, 22, and 24, in which each figure represents a jockey on a respective racehorse. The indicia is a front elevational view or a view as would be seen in a vertical plane with the horses facing the viewer.

A second game indicia 26 is contained on the surface of the card. The second game indicia is a second view of the figures shown in the first indicia. In the second indicia, the representation of the figures is as if the figures were viewed in a horizontal plane, or a top view of the horses and jockeys, thereby indicating the relative horizontal position of the horses and jockeys to show which horse is ahead of the others.

A third prize indicia 28 is included on the surface. The third prize indicia in this instance shows a monetary prize, however any suitable prize may be indicated from a soft drink to a prize of substantial value.

As may be best seen in FIG. 1, indicia 16 is covered with a layer 30 of a conventional and well known removable opaque coating material to hide from view of a player indicia 16.

A second layer 32 of a removable opaque coating material covers second indicia 26 to hide that second indicia from view of a player. The second layer in this instance includes a grid 34, which grid divides a second indicia into selected areas. The grid which provides a means for dividing up the second indicia into selected areas is arranged so that each of the figures in the second indicia is substantially completely in one given area. Thus, if the layer of removable coating is removed from one area, one figure is exposed.

Third indicia 28 is also covered with a third layer 36 of a removable opaque coating material to hide from view the third indicia.

The game is played in the following manner. The player first receives card 10 and the player then removes layer 30 to expose the first indicia. It may be appreciated that if the game cards are being distributed by an individual, the individual distributing the card does not know what is the arrangement of the first indicia when he makes the distribution. The first knowledge of the first indicia is when the player removes the first layer of removable coating material from the first indicia. Then, the player makes his selection as to which portions of the second layer of removable coating material are to be removed. It may be appreciated that when the player views the first indicia, which in this instance is a horserace of four horses, the view is a front elevational view, or the view which would be seen in a vertical plane. The player must exercise skill to determine the relative position of the horses in a horizontal plane. The player must not only select the proper longitudinal position of the horses, that is, the horse which is ahead of the other horses, but the player must also select the lateral position of the horses. In order to play the game, the player makes his selection and then removes the layer of removable opaque coating material from a selected area defined by the grid. If the player is skillful in playing the game, he selected four proper areas in the horizontal grid to position the horses and jockeys depicted in the first indicia, as shown in FIGS. 2 and 3. He then may remove the third layer of removable opaque coating material to determine what is his prize.

The game card device may be further modified to include a game of chance by adding an indicator, such as, star 38 adjacent to one of the figures, such as FIG. 34. A star or other symbol may be utilized to provide a bonus to a winner or to give a prize to a person who was not successful in uncovering the appropriate areas to disclose the figures within the allotted number of tries. It may be appreciated that the rules of the game may be varied to allow a player to uncover a number of areas equal to the number of figures to be found, or additional areas over and above the number of figures.

The present specific disclosure of the subject invention has been described in terms of an elevational view of a horserace and a horizontal view of the same horserace. Any number of arrangements and figures may be used to play the game, such as, automobiles, runners, boats, airplanes, or any other selected figures. Although a specific embodiment of the herein disclosed invention has been shown in the accompanying drawings and described in detail above, it is readily apparent that those skilled in the art may make various modifications and changes without departing from the spirit and scope of the present invention. It is to be expressly understood that the instant invention is limited only by the appended claims.

What is claimed is:

1. A skill game card device providing an apparatus for a game of skill for a player comprising; a substantially flat supporting sheet, a first indicia on the flat supporting sheet, said first indicia depicting a plurality of figures arranged in a given relationship as viewed in a given plane, a first layer of removable opaque coating material covering the first indicia to hide from view of a player the first indicia, a second indicia on the flat supporting sheet, said second indicia depicting the relative position of the figures depicted in the first indicia as viewed in a plane other than the plane of the first indicia, a second layer of removable opaque coating material covering the second indicia to hide from view of a player the second indicia, and means cooperative with the second layer of removable opaque coating material to distinguish areas of said second layer of removable opaque coating material and having separate indicia of separate figures under selected areas, whereby a player has an opportunity to select areas of the second layer of removable opaque coating material for removal to expose selected portions of the second indicia.

2. A skill game card device providing an apparatus for a game of skill for a player as defined in claim 1, including; a third indicia on the sheet identifying a prize, and a third layer of removable opaque coating material covering the third indicia.

3. A skill game card device providing an apparatus for a game of skill for a player as defined in claim 1 including; a third indicia on the sheet in cooperation with the second indicia and being covered with the second layer of removable opaque coating material.

4. A skill game card device providing an apparatus for a game of skill for a player as defined in claim 1, wherein said first indicia depicts the plurality of figures as viewed in a vertical plane, and said second indicia depicts the figures as viewed in a horizontal plane.

5. A skill game card device providing an apparatus for a game of skill for a player as defined in claim 1, wherein said first indicia depicts the plurality of figures moving in a given direction as viewed in a vertical plane substantially perpendicular to the direction of movement of the figures, and said second indicia depicts the relative position of the figures as viewed in a horizontal plane.

6. A skill game card device providing an apparatus for a game of skill for a player as defined in claim 1, wherein said means cooperative with the second layer of removable opaque coating material being a third indicia on the surface of the second layer of removable opaque coating material defining areas of the layer.

7. A skill game card device providing an apparatus for a game of skill for a player as defined in claim 1, including; a third indicia on the sheet in cooperation with the second indicia, said third indicia being covered with the second layer of removable opaque coating material, a fourth indicia on the sheet identifing a prize, and a third layer of removable opaque coating material covering the fourth indicia.

8. A skill game card device providing an apparatus for a game of skill for a player as defined in claim 1, wherein said first indicia depicts the plurality of figures as viewed in a vertical plane, and said second indicia depicts the figures as viewed in a horizontal plane, and including; a third indicia on the sheet identifing a prize, and a third layer of removable opaque coating material covering the third indicia to hide from view of a player said third indicia.

9. A skill game card device providing an apparatus for a game of skill for a player as defined in claim 1, wherein said first indicia depicts the plurality of figures moving in a given direction as viewed in a vertical plane substantially perpendicular to the direction of movement of the figures, and said second indicia depicts the relative position of the figures as viewed in a horizontal plane, and including; a third indicia on the sheet identifying a prize, and a third layer of removable opaque coating material covering the third indicia.

10. A skill game card device providing an apparatus for a game of skill for a player as defined in claim 1, wherein said means cooperative with the second layer of removable opaque coating material being a third indicia on the surface of the second layer of removable opaque coating material defining areas of the second layer and areas of the indicia immediately below its areas of the second layer, and including; a fourth indicia on the sheet identifying a prize, and a third layer of removable opaque coating material covering the fourth indicia to hide from view of a player said fourth indicia.

11. A skill game card device providing an apparatus for a game of skill for a player as defined in claim 1, wherein said first indicia depicts the plurality of figures as viewed in a vertical plane, said second indicia depicts the figures as viewed in a horizontal plane, and including; a third indicia on the sheet in cooperation with one of the figures as depicted in the second indicia, said third indicia being covered with the second layer of removable opaque coating material.

12. A skill game card device providing an apparatus for a game of skill for a player as defined in claim 1, wherein said first indicia depicts a plurality of figures moving in a given direction as viewed in a vertical plane substantially perpendicular to the direction of movement of the figures, said second indicia depicts the relative positions of the figures of the first indicia as viewed in a horizontal plane, and including; a third indicia on the sheet positioned in cooperation with one of the figures of the second indicia, said third indicia being covered with the second layer of removable opaque coating material.

13. A skill game card device providing an apparatus for a game of skill for a player as defined in claim 1, including; a third indicia on the sheet in cooperation with a selected figure of the second indicia, said third indicia being covered with the second layer of removable opaque coating material, and said means cooperative with the second layer of opaque coating material being a fourth indicia on the surface of the second layer of removable opaque coating material defining areas of the second layer with a separate figure under selected areas of the second layer, and the third indicia being in one of the selected areas.

14. A skill game card device providing an apparatus for a game of skill for a player as defined in claim 1, wherein said first indicia depicts the plurality of figures as viewed in a vertical plane, said second indicia depicts the figures as viewed in a horizontal plane, said first indicia depicts the plurality of figures moving in a given direction.

15. A skill game card device providing an apparatus for a game of skill for a player as defined in claim 1, wherein said first indicia depicts the plurality of figures as viewed in a vertical plane, said second indicia depicts the figures as viewed in a horizontal plane, and said means cooperative with the second layer of removable opaque coating material being a third indicia on the surface of the second layer of removable opaque coating defining areas of the second layer and having a figure of the second indicia positioned in each of selected areas below the second layer.

16. A skill game card device providing an apparatus for a game of skill for a player as defined in claim 1, wherein said first indicia depicts the plurality of figures moving in a given direction as viewed in a vertical plane substantially perpendicular to the direction of movement of the figures, said second indicia depicts the relative position of the figures as viewed in a horizontal plane, and said means cooperative with the second layer of removable opaque coating material being a third indicia on the surface of the second layer of removable opaque coating material defining areas of the second layer with figures of the second indicia positioned in each of selected areas below selected areas of the second layer of removable opaque coating material.

17. A skill game card device providing an apparatus for a game of skill for a player as defined in claim 1, wherein said first indicia depicts the plurality of figures moving in a given direction as viewed in a vertical plane substantially perpendicular to the direction of movement of the figures, said second indicia depicts the relative position of the figures as viewed in a horizontal plane, said means cooperative with the second layer of removable opaque coating material being a third indicia on the surface of the second layer of removable opaque coating material defining areas of the second layer, and including; a third indicia on the sheet positioned in cooperation with a figure of the second indicia, said third indicia being covered with the second layer of removable opaque coating material to hide from view of a player said third indicia, a fourth indicia on the sheet, said fourth indicia on the sheet identifying a prize, and a third layer of removable opaque coating material covering the fourth indicia to hide from view of a player said fourth indicia.

* * * * *

UNITED STATES PATENT AND TRADEMARK OFFICE

CERTIFICATE OF CORRECTION

PATENT NO. : 4,491,319

DATED : Jan. 1, 1985

INVENTOR(S) : Edward D. Nelson

It is certified that error appears in the above-identified patent and that said Letters Patent are hereby corrected as shown below:

In The Abstract, Line 15, cancel "Means cooperate" and substitute therefor --An indicia grid defining separate areas cooperates--

Signed and Sealed this

*Twenty-third* Day of *April 1985*

[SEAL]

*Attest:*

DONALD J. QUIGG

*Attesting Officer*

*Acting Commissioner of Patents and Trademarks*